US010008320B2

(12) United States Patent
Igarashi et al.

(10) Patent No.: US 10,008,320 B2
(45) Date of Patent: Jun. 26, 2018

(54) COIL COMPONENT

(71) Applicant: MURATA MANUFACTURING CO., LTD., Kyoto-fu (JP)

(72) Inventors: Akio Igarashi, Nagaokakyo (JP); Koji Onishi, Nagaokakyo (JP); Takashi Murakami, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days. days.

(21) Appl. No.: 15/587,483

(22) Filed: May 5, 2017

(65) Prior Publication Data

US 2018/0005751 A1 Jan. 4, 2018

(30) Foreign Application Priority Data

Jun. 29, 2016 (JP) ..... 2016-128234

(51) Int. Cl.
*H01F 27/29* (2006.01)
*H01F 27/28* (2006.01)

(52) U.S. Cl.
CPC ..... *H01F 27/292* (2013.01); *H01F 27/2823* (2013.01)

(58) Field of Classification Search
CPC .... H01F 27/292; H01F 27/2823; H01F 27/28; H01F 27/29; H01F 17/045
USPC ..... 336/83, 192, 170
See application file for complete search history.

(56) References Cited

U.S. PATENT DOCUMENTS

2005/0052267 A1* 3/2005 Singu ..... H01F 17/045 336/83
2014/0332260 A1* 11/2014 Sato ..... H01C 1/14 174/258
2015/0084731 A1* 3/2015 Takagi ..... H01F 19/08 336/212

FOREIGN PATENT DOCUMENTS

JP 2014-099586 A 5/2014

* cited by examiner

*Primary Examiner* — Mangtin Lian
(74) *Attorney, Agent, or Firm* — Studebaker & Brackett PC

(57) ABSTRACT

A coil component including a core, first metal terminals, second metal terminals and a wire. The first metal terminals and second metal terminals have mounting portions provided above the mounting surface and aligned above the mounting surface. One of the mounting portions of the first metal terminals has a first end surface facing one of the mounting portions of the second metal terminals and a second end surface other than the first end surface, and the first end surface has a chopped trace where surface roughness is higher than surface roughness of the second end surface.

6 Claims, 7 Drawing Sheets

--Prior Art--

--Prior Art--

COIL COMPONENT

CROSS REFERENCE TO RELATED APPLICATIONS

This application claims benefit of priority to Japanese Patent Application 2016-128234 filed Jun. 29, 2016, the entire content of which is incorporated herein by reference.

TECHNICAL FIELD

The present disclosure relates to a coil component having a core formed by winding a wire, and in particular, relates to a form of a metal terminal to which end portions of the wire are connected.

BACKGROUND

For example, Japanese Unexamined Patent Application Publication No. 2014-99586 discloses an interesting technique for the present disclosure. FIG. 7 is created based on FIG. 14 in Japanese Unexamined Patent Application Publication No. 2014-99586. FIG. 7 is a bottom view illustrating a state during manufacturing of a surface mounting-type coil component, that is, a state before metal terminals 2 to 7 mounted on a core 1 are separated from lead frames 8 and 9.

With reference to FIG. 7, the core 1 has a winding core portion 10 and first and second flange portions 11 and 12 provided at respective end portions of the winding core portion 10. Although not illustrated in the drawing, for example, four wires are wound around the winding core portion 10. The first and second flange portions 11 and 12 have inner end surfaces 13 and 14, outer end surfaces 15 and 16, and mounting surfaces 17 and 18, respectively. The inner end surfaces 13 and 14 face the winding core portion 10 side and respective end portions of the winding core portion 10 are located thereon. The outer end surfaces 15 and 16 face outward to the sides opposite to the inner end surfaces 13 and 14, respectively. The mounting surfaces 17 and 18 couple the inner end surfaces 13 and 14 and the outer end surfaces 15 and 16 and face a mounting substrate (not illustrated) side in mounting.

FIG. 8 is a bottom view illustrating the core 1 on which the six metal terminals 2 to 7 separated from the lead frames 8 and 9 illustrated in FIG. 7 are mounted, that is, is a view illustrating the core 1 in a state when viewed from the side of the mounting surfaces 17 and 18. FIG. 8 illustrates conductive lands 19 to 24 provided on the mounting substrate by dashed lines.

The three metal terminals 2 to 4 are provided on the first flange portion 11 and the three metal terminals 5 to 7 are provided on the second flange portion 12. The metal terminals 2 to 4 have mounting portions 25 to 27 extending along the mounting surface 17 of the first flange portion 11, respectively. These mounting portions 25 to 27 are aligned on the mounting surface 17 in a direction orthogonal to a central axial line of the winding core portion 10. In the same manner, the metal terminals 5 to 7 have mounting portions 28 to 30 extending along the mounting surface 18 of the second flange portion 12, respectively. These mounting portions 28 to 30 are aligned on the mounting surface 18 in a direction orthogonal to a central axial line of the winding core portion 10. The alignment direction of the mounting portions 25 to 27 and the mounting portions 28 to 30 as described above is indicated by a two-headed arrow A in FIG. 8.

One end portion of two wires of the four wires (not illustrated) are respectively connected to the metal terminals 2 and 3 and the other end portion thereof are commonly connected to the metal terminal 7. One end portions of the remaining two wires of the four wires are commonly connected to the metal terminal 4 and the other end portions thereof are respectively connected to the metal terminals 5 and 6.

The metal terminals 2 to 7 are made to adhere to the flange portions 11 and 12 with an adhesive, and then, are separated from the lead frames 8 and 9. Cut lines located at separation positions are indicated by dashed lines C1 to C6 in FIG. 7. Although not directly described in Japanese Unexamined Patent Application Publication No. 2014-99586, it is difficult to apply a precise cutting process, that is, a shearing process by press processing using an acute punching tool to the separation because the separation is performed after the metal terminals 2 to 7 are fixed to the flange portions 11 and 12 with the adhesive. Accordingly, a non-precise breaking process is normally applied to the separation. In the example of the breaking process a substantially V-shaped groove partially formed on the lead frame in advance by press processing or the like to lower the hardness of the lead frame is subject to brittle fracture by pulling processing or folding processing.

SUMMARY

The coil component including the core 1 and the metal terminals 2 to 7 as described above is normally mounted on the mounting substrate by employing a reflow process using solder pastes. To be more specific, as illustrated in FIG. 8, the metal terminals 2 to 7 are soldered on the conductive lands 19 to 24 on the mounting substrate, respectively. However, in the reflow process, the coil component on the mounting substrate may rotate or shift in the above-described alignment direction A in some cases. As a result, a short circuit is easy to occur, in particular, between the metal terminals 2 and 3 or between the metal terminals 5 and 6 between which an interval is relatively narrow.

It is considered that such a disadvantage occurs because of properties, directions, positions, and the like of cracks T1 to T6 generated by the separation along the cut lines C1 to C6.

First, the cracks T1 to T6 are formed such that the mounting portions 25 to 30 of the metal terminals 2 to 7 project from long sides of substantially rectangular shapes defined by the mounting portions 25 to 30 and direct to the same direction as the alignment direction A of the mounting portions 25 to 30 of the metal terminals 2 to 7.

Under this condition, the cracks T1 to T6 are obtained by the separation of the metal terminals 2 to 7 from the lead frames 8 and 9 by the non-precise breaking process as described above. Therefore, the surface roughness of the cracks T1 to T6 is higher than that of the other end surfaces and forms of the cracks T1 to T6 are unstable. Burrs are generated on the cracks T1 to T6 in some cases. Due to this, some cracks T1 to T6 have lower wettability than the others and variation in the wettability is increased among the cracks T1 to T6.

If the above-described variation in the wettability is generated among the cracks T1 to T6, the wettability varies randomly along the alignment direction of the cracks T1 to T6, that is, along the alignment direction A of the mounting portions 25 to 27 and 28 to 30.

It is considered that the variation in the wettability causes the coil component on the mounting substrate to rotate or shift in the alignment direction A in the reflow process. As a result, the short circuit may easily occur, in particular, between the metal terminals 2 and 3 or between the metal terminals 5 and 6 between which an interval is relatively narrow.

Accordingly, it is an object of the present disclosure to provide a coil component that is difficult to rotate or shift in a reflow process even when the wettability varies among the cracks as described above.

One embodiment of the present disclosure is a coil component including a core having a winding core portion, a first flange portion, and a second flange portion, the first flange portion and the second flange portion are provided at end portions of the winding core portion, first metal terminals provided on the first flange portion, second metal terminals provided on the second flange portion, and a wire wound around the winding core portion and connected to one of the first metal terminals and one of the second metal terminals.

In the coil component, each of the first flange portion and the second flange portion has a mounting surface facing a mounting substrate side in mounting, each of the first metal terminals and second metal terminals has a mounting portion provided above the mounting surface, the mounting portions of the first metal terminals are aligned above the mounting surface of the first flange portion in a direction orthogonal to a central axial line of the winding core portion, and the mounting portions of the second metal terminals are aligned above the mounting surface of the second flange portion in the direction orthogonal to the central axial line.

In the coil component, one of the mounting portions of the first metal terminals has a first end surface facing one of the mounting portions of the second metal terminals and a second end surface other than the first end surface, and the first end surface has a crack where surface roughness is higher than surface roughness of the second surface.

The crack on which the surface roughness is higher as described above is generated by separation from a lead frame in a non-precise breaking process, for example. Therefore, variation in wettability is inevitable. The variation in the wettability however gives less influence in a reflow process because the crack is located on the first end surface of the mounting portion of one of the first metal terminals, which faces one of the mounting portions of the second metal terminals.

It is preferable that in the coil component each of the mounting portions of the first metal terminals has a first end surface facing one of the mounting portions of the second metal terminals and a second end surface other than the first end surface, and each of the first end surfaces has a crack where surface roughness is higher than surface roughness of the second end surfaces. It is more preferable that in the coil component each of the mounting portions of the second metal terminals has a first end surface facing one of the mounting portions of the first metal terminals and a second end surface other than the first end surface, and each of the first end surfaces has a crack where surface roughness is higher than surface roughness of the second end surfaces. The more the first end surfaces have a crack, the less the variation in the wettability gives influence in a reflow process.

It is preferable that the coil component further includes a plurality of wires each wound around the winding core portion and connected to one of the first metal terminals and one of the second metal terminals.

It is preferable that in the coil component each of the first metal terminals has an extended portion which extends from the mounting portion along an outer end surface of the first flange portion via a bent portion. It is preferable that in the coil component each of the second metal terminals has an extended portion which extends from the mounting portion along an outer end surface of the second flange portion via a bent portion also. With this configuration, solder fillets are easy to be formed in a mounted state on the mounting substrate. Accordingly, an appearance check whether or not appropriate soldering has been achieved can be easily performed.

With the coil component according to the disclosure, the variation in the wettability gives less influence in the reflow process. Accordingly, the coil component can be made difficult to rotate or shift in the reflow process. As a result, a short circuit can be made difficult to occur among the metal terminals.

Other features, elements, characteristics and advantages of the present disclosure will become more apparent from the following detailed description with reference to the attached drawings.

DETAILED DESCRIPTION

Figure 1:
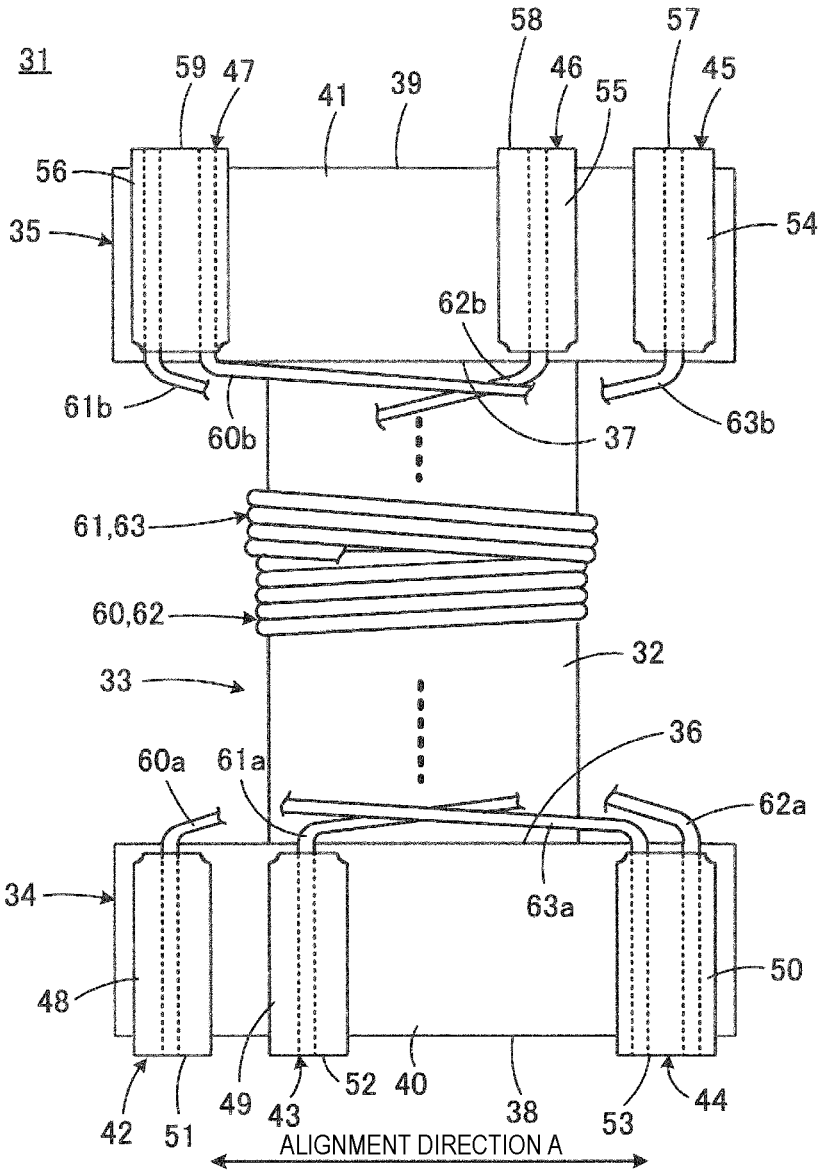
FIG. 1 is a bottom view illustrating a coil component according to an embodiment of the disclosure.

A coil component 31 according to an embodiment of the disclosure will be described with reference to FIG. 1 to FIG. 6. The coil component 31 illustrated in the drawings configures a surface mounting-type pulse transformer as an example of a coil component.

The coil component 31 incudes a core 33 forming a winding core portion 32. The core 33 includes first and second flange portions 34 and 35 provided at respective end portions of the winding core portion 32. The core 33 is configured by, for example, a magnetic member such as ferrite.

Figure 2:
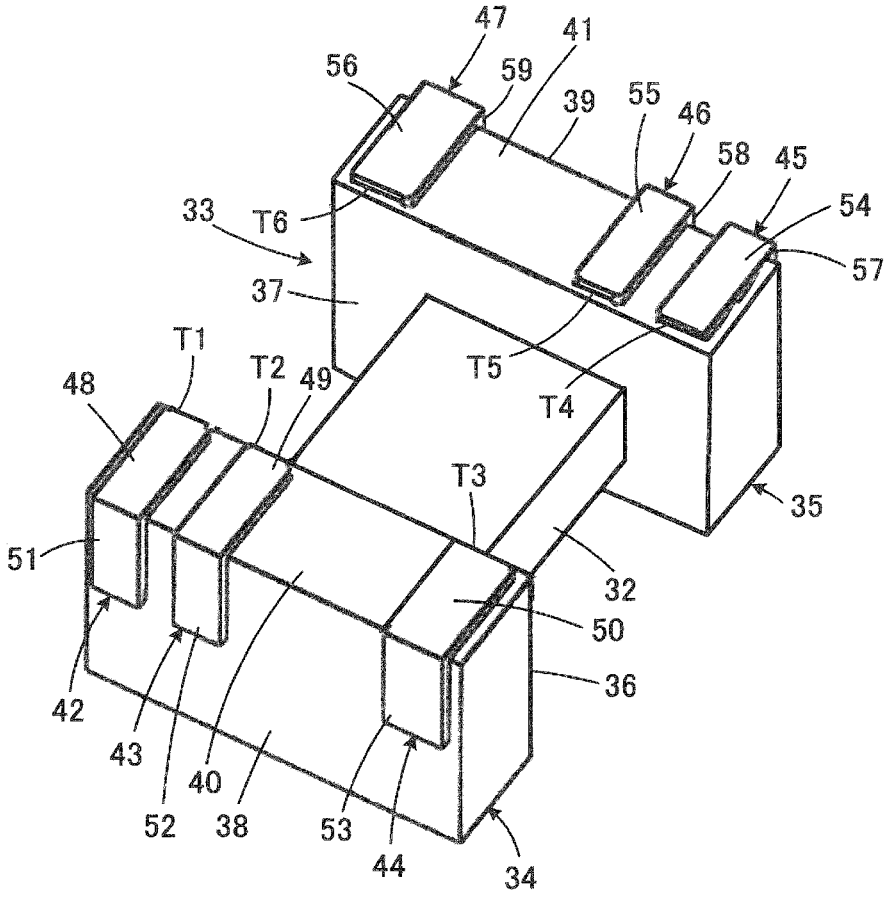
FIG. 2 is a perspective view illustrating a core and metal terminals included in the coil component illustrated in FIG. 1 when viewed from the bottom surface side.

The flange portions 34 and 35 have substantially rectangular cross-sectional shapes as is seen from FIG. 2. The flange portions 34 and 35 include inner end surfaces 36 and 37, outer end surfaces 38 and 39, and mounting surfaces 40 and 41, respectively. The inner end surfaces 36 and 37 face the winding core portion 32 side and the respective end portions of the winding core portion 32 are located thereon. The outer end surfaces 38 and 39 face outward to the sides opposite to the inner end surfaces 36 and 37, respectively.

The mounting surfaces 40 and 41 couple the inner end surfaces 36 and 37 and the outer end surfaces 38 and 39 and face a mounting substrate (not illustrated) side in mounting.

Three first metal terminals 42 to 44 are provided on the first flange portion 34 and three second metal terminals 45 to 47 are provided on the second flange portion 35.

The first metal terminals 42 to 44 have mounting portions 48 to 50 provided above and extending along the mounting surface 40 of the first flange portion 34 and extended portions 51 to 53 extending from the mounting portions 48 to 50 along the outer end surface 38 of the first flange portion 34 via bent portions, respectively.

The second metal terminals 45 to 47 also have mounting portions 54 to 56 provided above and extending along the mounting surface 41 of the second flange portion 35 and extended portions 57 to 59 extending from the mounting portions 54 to 56 along the outer end surface 39 of the second flange portion 35 via bent portions, respectively, in the same manner as the first metal terminals 42 to 44.

The above-described extended portions 51 to 53 and 57 to 59 make it easy to form solder fillets in a mounted state on the mounting substrate. Accordingly, an appearance check whether or not appropriate soldering has been achieved can be easily performed.

The mounting portions 48 to 50 of the three first metal terminals 42 to 44 are aligned above the mounting surface 40 of the first flange portion 34 in a direction orthogonal to a central axial line of the winding core portion 32 in this order. On the other hand, the mounting portions 54 to 56 of the three second metal terminals 45 to 47 are also aligned above the mounting surface 41 of the second flange portion 35 in the direction orthogonal to the central axial line of the winding core portion 32 in this order. The alignment direction of the above-described mounting portions 48 to 50 and mounting portions 54 to 56 is indicated by a two-headed arrow A in FIG. 1 and FIG. 3.

As illustrated in FIG. 1, the coil component 31 further includes four wires 60 to 63 wound around the winding core portion 32. Each of wires 60 to 63 is formed by insulation-coated conductive wire and is connected to one of the first metal terminals 42 to 44 and one of the second metal terminals 45 to 47.

The wires 60 to 63 are wound so as to form two layers on the winding core portion 32. To be more specific, the first wire 60 and the third wire 62 are located at the lower layer side while being bifilar-wound and the second wire 61 and the fourth wire 63 are located at the upper layer side while being bifilar-wound. It should be noted that in FIG. 1, the wires 60 to 63 are illustrated, the parts of which are omitted.

The winding direction of the above-described first wire 60 and third wire 62 located at the lower layer side and the winding direction of the above-described second wire 61 and fourth wire 63 located at the upper layer side are reversed. It should be noted that the winding direction of the first wire 60 and third wire 62 and the winding direction of the second wire 61 and fourth wire 63 may be opposite to those illustrated in the drawing as long as the winding direction of the first wire 60 and third wire 62 and the winding direction of the second wire 61 and fourth wire 63 are reversed.

One end 60*a* of the first wire 60 is connected to the first metal terminal 42 and the other end 60*b* thereof is connected to the second metal terminal 47.

One end 61*a* of the second wire 61 is connected to the first metal terminal 43 and the other end 61*b* thereof is connected to the second metal terminal 47.

One end 62*a* of the third wire 62 is connected to the first metal terminal 44 and the other end 62*b* thereof is connected to the second metal terminal 46.

One end 63*a* of the fourth wire 63 is connected to the first metal terminal 44 and the other end 63*b* thereof is connected to the second metal terminal 45.

The above-described wires 60 to 63 and metal terminals 42 to 44 and 45 to 47 are connected by, for example, thermal pressure bonding, welding, or the like.

The first metal terminals 42 and 43 function as a positive terminal and a negative terminal of input, respectively. Furthermore, the second metal terminals 45 and 46 function as a positive terminal and a negative terminal of output, respectively.

In the embodiment, the third and fourth wires 62 and 63 are commonly connected to the first metal terminal 44 and the first and second wires 60 and 61 are commonly connected to the second metal terminal 47. Instead of this configuration, the first metal terminal 44 may be divided such that the third and fourth wires 62 and 63 are separately connected thereto and the second metal terminal 47 may be divided such that the first and second wires 60 and 61 are separately connected thereto.

The first wire 60 and the second wire 61 form a primary winding wire of a pulse transformer configured by the coil component 31 and the third wire 62 and the fourth wire 63 form a secondary winding wire of the pulse transformer.

Next, a mounting process of the metal terminals 42 to 47 on the core 33, which is executed in manufacturing of the coil component 31, will be described.

Figure 4:
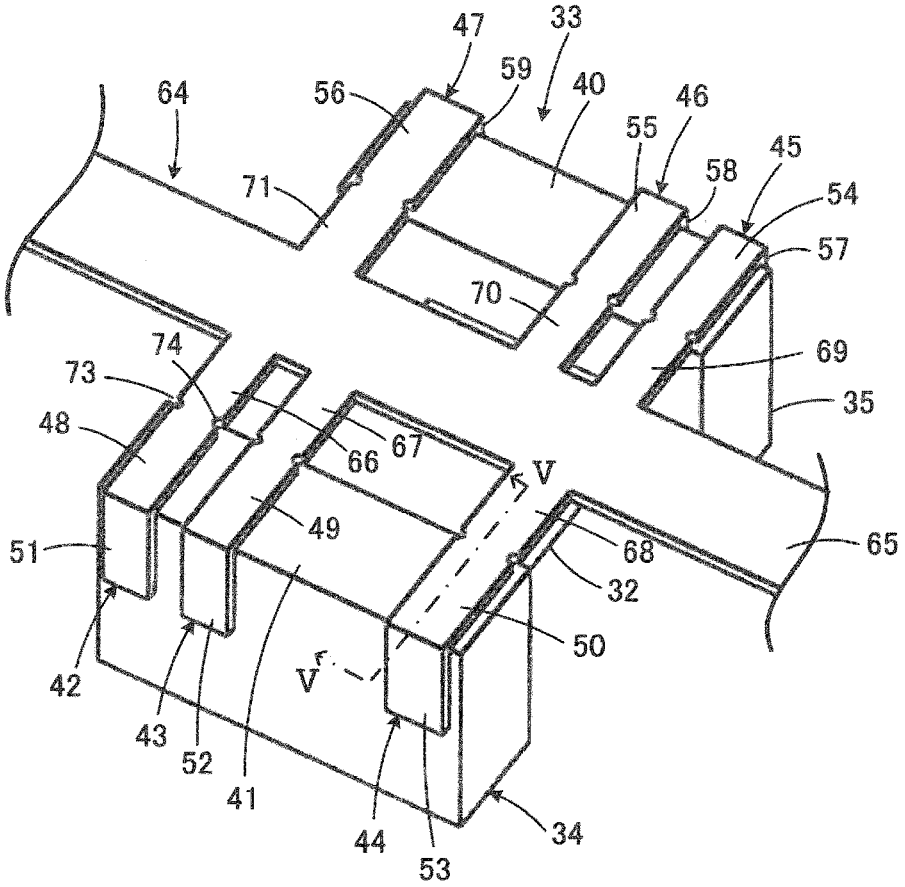
FIG. 4 is a perspective view illustrating a state during manufacturing of the coil component illustrated in FIG. 1 when seen from the bottom surface side.
Figure 7:
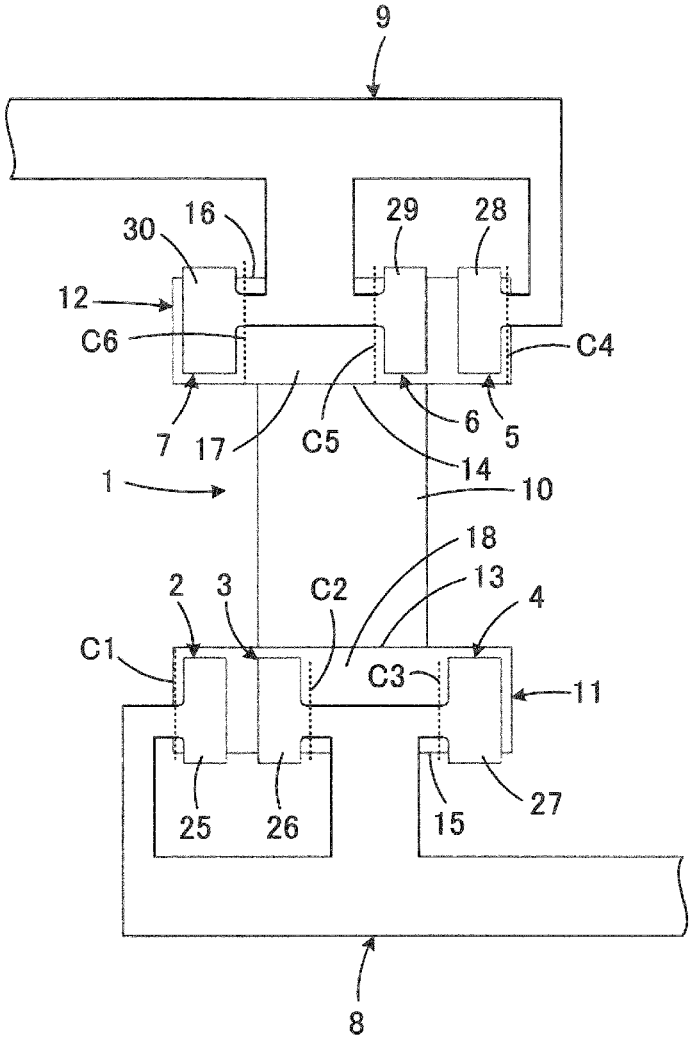
FIG. 7 is a bottom view illustrating a state during manufacturing of a coil component described in Japanese Unexamined Patent Application Publication No. 2014-99586.
Figure 8:
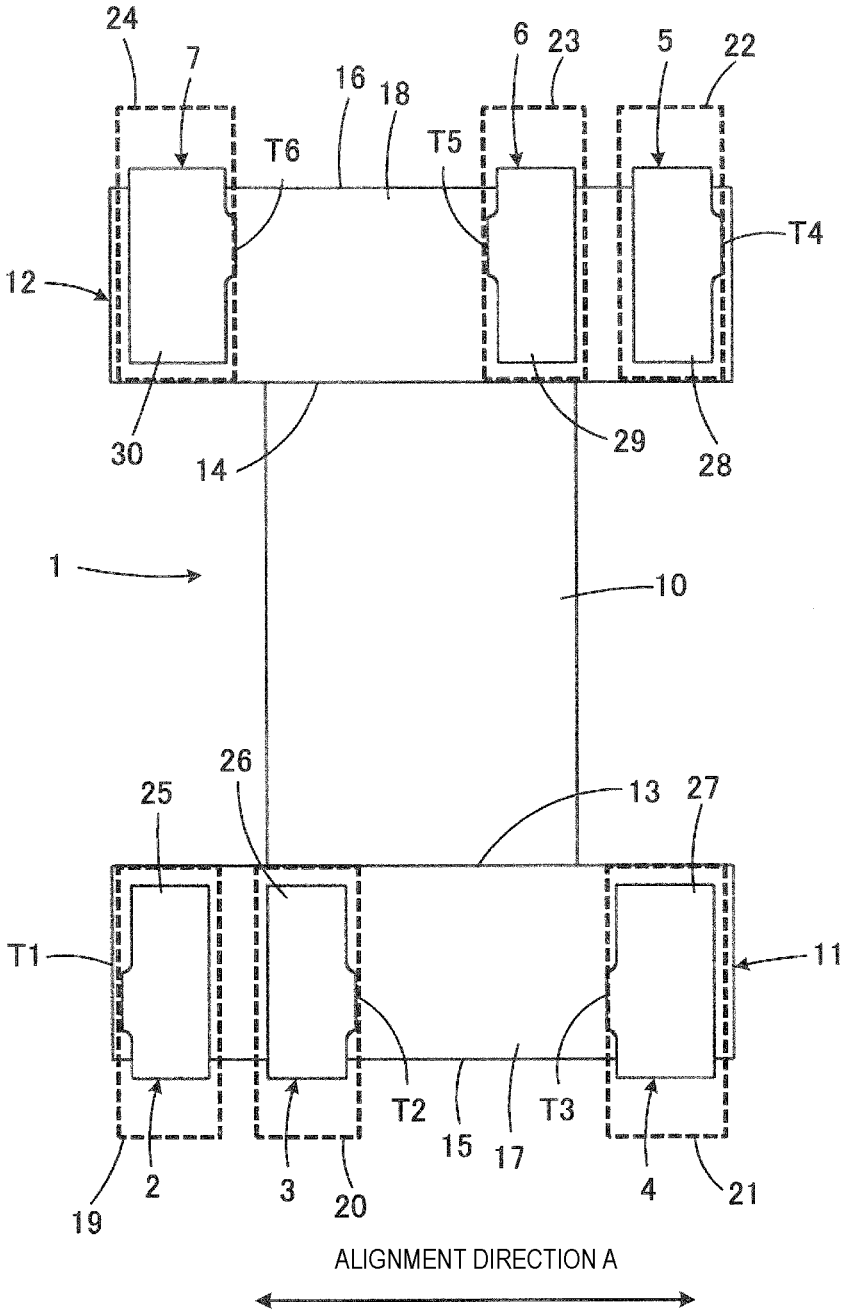
FIG. 8 is a bottom view illustrating a core and metal terminals included in the coil terminal illustrated in FIG. 7 together with conductive lands of a mounting substrate.

The metal terminals 42 to 47 are provided by a lead frame 64 as illustrated in FIG. 4. The lead frame 64 includes a relatively wide coupling trunk 65 and a plurality of coupling branches 66 to 71 extending to the lateral sides from the coupling trunk 65. The lead frame 64 has such a shape that the coupling branches 66 to 68 protrude to one side of the coupling trunk 65 and the coupling branches 69 to 71 protrude to the other side in the same manner. Therefore, one lead frame 64 can provide all of the metal terminals 42 to 47. That is to say, the two lead frames 8 and 9 as illustrated in FIG. 7 are not necessary.

Figure 5:
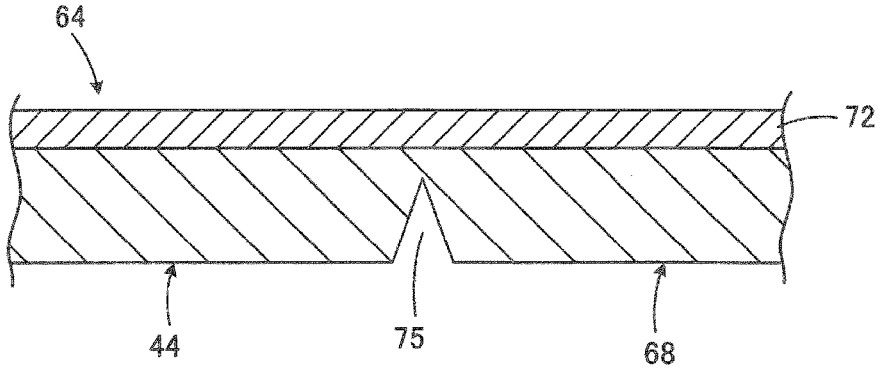
FIG. 5 is an enlarged cross-sectional view along line V-V in FIG. 4.

The lead frame 64 can be provided by applying a relatively precise cutting process, for example, a shearing process with an acute punching tool to a metal plate made of, for example, a copper-based alloy such as phosphor bronze and tough pitch copper. It is preferable that a plating film 72 made of, for example, tin be formed in the metal plate configuring the lead frame 64 as illustrated in FIG. 5.

The respective metal terminals 42 to 47 are formed at the sides of the free ends of the above-described coupling branches 66 to 71, respectively. In order to easily separate the metal terminals 42 to 47 from the coupling branches 66 to 71, respectively, pairs of cutouts 73 and 74 opposing each other are provided at boundary positions between the metal terminals 42 to 47 and the coupling branches 66 to 71. Furthermore, as illustrated in FIG. 5, substantially V-shaped grooves 75 are also provided at the above-described boundary positions preferably for making the separation easy. FIG. 5 is a cross-sectional view along line V-V in FIG. 4. Although FIG. 5 illustrates the metal terminal 44 and the coupling branch 68, the other metal terminals 42 and 43 and 45 to 47 and the other coupling branches 66 and 67 and 69 to 71 also have the same configuration.

Although in the embodiment illustrated by the drawing, the substantially V-shaped grooves 75 are provided on the surface at the opposite to the surface on which the plating film 72 is formed, the substantially V-shaped grooves 75 may be provided on the surface on which the plating film 72 is formed in addition to or instead of them.

The respective metal terminals 42 to 47 are made to adhere to the flange portions 34 and 35 with the adhesive, and then, are separated from the lead frame 64 at positions corresponding to the cutouts 73 and 74 and the substantially V-shaped grooves 75. A non-precise breaking process is applied to the separation.

Figure 3:
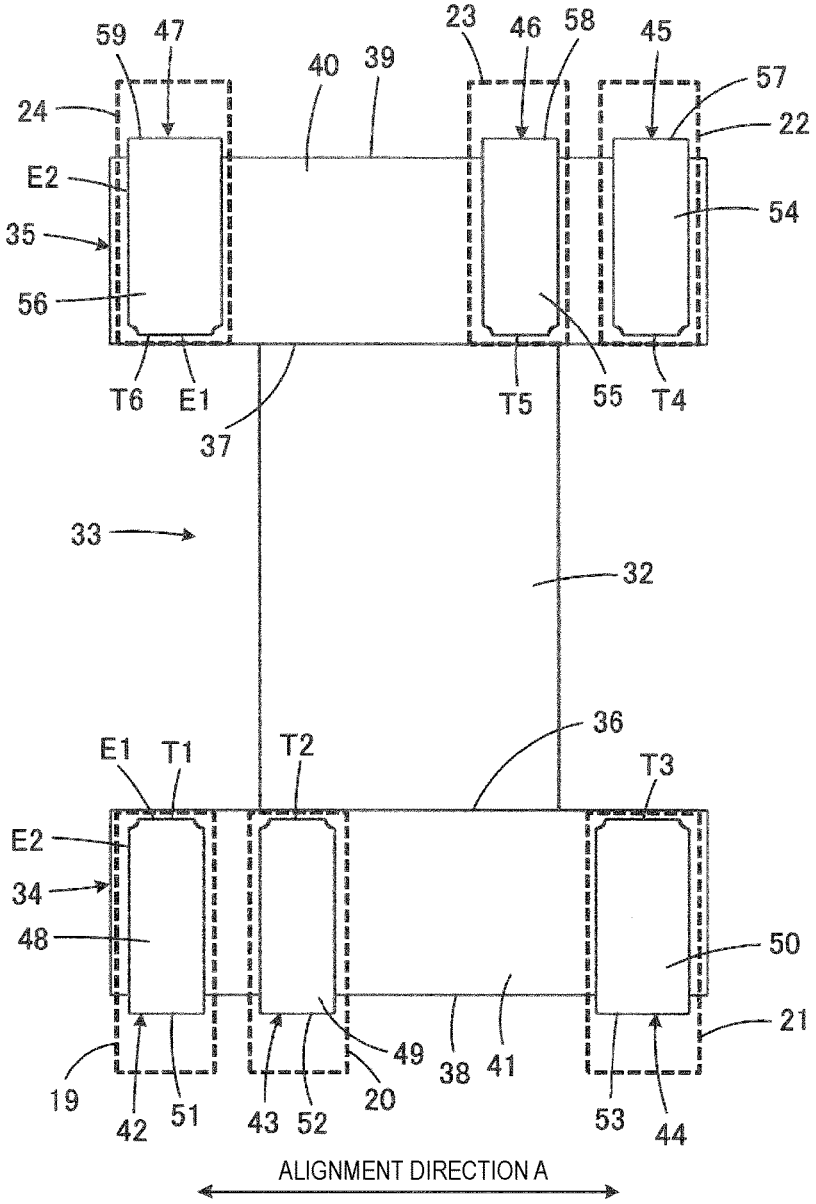
FIG. 3 is a bottom view illustrating the core and the metal terminals included in the coil component illustrated in FIG. 1 together with conductive lands on a mounting substrate.

The above-described separation causes cracks T1 to T6 to remain on the metal terminals 42 to 47, respectively, as illustrated in FIG. 2 and FIG. 3. In particular, FIG. 6 illustrates the end surface of the metal terminal 44 with the crack T3.

Figure 6:
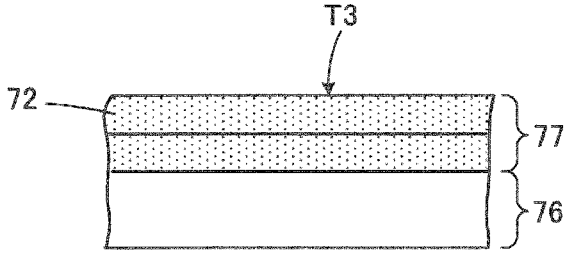
FIG. 6 is an end surface view illustrating a crack of the metal terminal in the coil component illustrated in FIG. 1.

With reference to FIG. 6, a surface 77 having a relatively high surface roughness, which is generated in the non-precise cutting process, is formed on the crack T3 in addition to a relatively smooth surface 76 defining one side wall of the substantially V-shaped groove 75. Although not illustrated in the drawing, the cracks T1, T2, and T4 to T6 of the other metal terminals 42, 43, and 45 to 47 also have the same form as that of the crack T3.

The respective mounting portions 48 to 50 of the first metal terminals 42 to 44 and the respective mounting portions 54 to 56 of the second metal terminals 45 to 47 have first end surfaces El facing each other and second end surfaces E2 other than the first end surfaces E1 (see FIG. 3). The cracks T1 to T6 forming the above-described relatively rough surfaces 77 are located on the first end surfaces E1.

Irregularities and burrs may be generated on the cracks T1 to T6 in some cases due to surface roughness and the forms of the cracks T1 to T6 are not stable. Therefore, generation of variation in wettability among the cracks T1 to T6 is inevitable. The cracks T1 to T6 are however located on the facing first end surfaces E1 of the respective mounting portions 48 to 50 of the first metal terminals 42 to 44 and the respective mounting portions 54 to 56 of the second metal terminals 45 to 47. Therefore, even when shifting occurs in a reflow process in which the metal terminals 42 to 47 are soldered onto the conductive lands 19 to 24 on the mounting substrate, respectively, as illustrated in FIG. 3, they shift in the direction toward or farther from the respective first end surfaces E1 from the metal terminals 42 to 47, that is, in the direction that is different from the alignment direction of the metal terminals. As a result, a short circuit can be made difficult to occur among the metal terminals 42 to 44 and among the metal terminals 45 to 47.

Although in the above-described embodiment, the cracks T1 to T6 located on the first end surfaces E1 and the second end surfaces E2 are distinguished from each other based on the surface roughness, other factors, for example, metal tissues on the end surfaces may be considered. It should be noted that "surface roughness" defined by ISO 25178 can be used as the surface roughness. Furthermore, it is sufficient that the surface roughness is measured under, for example, a laser microscope.

Hereinbefore, in the description of the coil component according to the disclosure, the pulse transformer is adopted as the embodiment. However, the disclosure can be also applied to any coil component as long as a plurality of first and second metal terminals are respectively provided on a first flange portion and a second flange portion, and respective mounting portions of the first and second metal terminals are aligned above the mounting surfaces of the first and second flange portions in the direction orthogonal to the central axial line of the winding core portion. For example, the coil component may be a common mode choke coil, a transformer, a balun, or the like.

Accordingly, any number of wires and any number of metal terminals on the respective flange portions may be arbitrarily provided. For example, one wire can have a three-terminal configuration, which is connected to the metal terminals at three points of both ends and an intermediate portion. Furthermore, a dummy terminal that is connected to no wire can be formed as the metal terminal in some cases. When even such a dummy terminal is connected to the conductive land of a signal line, characteristics are adversely affected in some cases. Therefore, in this case, the disclosure is also effective. As described above, the number of wires and the number of metal terminals are not necessarily correlated with each other.

It should be understood that an embodiment in which the first end surfaces of the mounting portions of only one among the first metal terminals and the second metal terminals have the crack generated in the non-precise breaking process is also within the scope of the embodiment of the disclosure.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a core having a winding core portion, a first flange portion, and a second flange portion, the first flange portion and the second flange portion are provided at end portions of the winding core portion;

first metal terminals provided on the first flange portion;

second metal terminals provided on the second flange portion; and a wire wound around the winding core portion and connected to one of the first metal terminals and one of the second metal terminals, wherein each of the first flange portion and the second flange portion has a mounting surface facing a mounting substrate side in mounting, each of the first metal terminals and second metal terminals has a mounting portion provided above the mounting surface, the mounting portions of the first metal terminals are aligned above the mounting surface of the first flange portion in a direction orthogonal to a central axial line of the winding core portion, the mounting portions of the second metal terminals are aligned above the mounting surface of the second flange portion in the direction orthogonal to the central axial line, one of the mounting portions of the first metal terminals has a first end surface facing one of the mounting portions of the second metal terminals and a second end surface other than the first end surface, and the first end surface has a crack where surface roughness is higher than surface roughness of the second end surface.

2. The coil component according to claim 1, wherein each of the mounting portions of the first metal terminals has a first end surface facing one of the mounting portions of the second metal terminals and a second end surface other than the first end surface, and each of the first end surfaces has a crack where surface roughness is higher than surface roughness of the second end surfaces.

3. The coil component according to claim 1, wherein each of the mounting portions of the second metal terminals has a first end surface facing one of the mounting portions of the first metal terminals and a second end surface other than the first end surface, and each of the first end surfaces has a crack where surface roughness is higher than surface roughness of the second end surfaces.

4. The coil component according to claim 1, further comprising a plurality of wires each wound around the winding core portion and connected to one of the first metal terminals and one of the second metal terminals.

5. The coil component according to claim 1, wherein each of the first metal terminals has an extended portion which extends from the mounting portion along an outer end surface of the first flange portion via a bent portion.

6. The coil component according to claim 5, wherein each of the second metal terminals has an extended portion which extends from the mounting portion along an outer end surface of the second flange portion via a bent portion.

* * * * *